US005521629A

United States Patent [19]

Deboer et al.

[11] Patent Number: 5,521,629

[45] Date of Patent: May 28, 1996

[54] METHOD AND APPARATUS FOR LASER DYE ABLATION PRINTING WITH HIGH INTENSITY LASER DIODE

[75] Inventors: Charles D. Deboer, Rochester; Seung H. Baek, Pittsford, both of N.Y.

[73] Assignee: Eastman Kodak Company, Rochester, N.Y.

[21] Appl. No.: 249,507

[22] Filed: May 26, 1994

[51] Int. Cl.[6] ..... B41M 5/035; G03C 1/72

[52] U.S. Cl. ..... 347/262; 347/188; 347/193; 347/264; 347/139

[58] Field of Search ..... 347/188, 193, 347/262, 264, 139; 430/523

[56] References Cited

U.S. PATENT DOCUMENTS

| | | | |
|---|---|---|---|
| 4,904,498 | 2/1990 | Wu | 427/53.1 |
| 4,916,048 | 4/1990 | Yamada et al. | 430/523 |
| 4,973,572 | 11/1990 | DeBoer | 503/227 |
| 5,156,938 | 10/1992 | Foley et al. | 430/200 |
| 5,219,703 | 6/1993 | Bugner et al. | 430/200 |
| 5,227,277 | 7/1993 | Waterman | 430/253 |
| 5,241,328 | 8/1993 | Sarraf et al. | 346/76 |
| 5,256,506 | 10/1993 | Ellis et al. | 430/20 |
| 5,262,275 | 11/1993 | Fan | 430/273 |

FOREIGN PATENT DOCUMENTS

| | | | |
|---|---|---|---|
| 0636491 | 2/1995 | European Pat. Off. | B41M 5/24 |
| 0644060 | 3/1995 | European Pat. Off. | B41M 5/24 |
| 2083726 | 3/1982 | United Kingdom | H04N 1/22 |

OTHER PUBLICATIONS

Journal of the Electrochemical Society, vol. 135, No. 5, May 1988, pp. 1275–1278, "Heat–Mode Lithography with Dye Deposited Films", Akira Morinaka and Shigeru Oikawa (see col. 2, paragraph 1).

*Primary Examiner*—Benjamin R. Fuller
*Assistant Examiner*—Raquel Yvette Gordon
*Attorney, Agent, or Firm*—Nelson Adrian Blish

[57] ABSTRACT

A method and apparatus for performing laser dye ablation printing utilizing a laser diode with improved contrast and uniformity produces exposed film having a minimum optical density (Dmin) of less than 0.11 and exhibiting significant reductions in visible raster lines. Specifically, a laser printing apparatus is provided that includes a mechanism for retaining a film to be exposed, a laser diode source for generating a write beam, and a mechanism for scanning the write beam across the film to generate an image. The intensity of write beam generated by the laser diode source at the film is preferably at least 1.0 mW/square micron. During operation, a film to be exposed is placed in the retaining mechanism and the write beam is scanned across the film to generate an image.

12 Claims, 1 Drawing Sheet

METHOD AND APPARATUS FOR LASER DYE ABLATION PRINTING WITH HIGH INTENSITY LASER DIODE

FIELD OF THE INVENTION

The invention relates in general to the field of laser printing. More specifically, the invention relates to a method and apparatus for performing laser dye ablation printing utilizing a high intensity laser diode source.

BACKGROUND

Printing systems that utilize the physical interaction of a laser beam with a coated film material are commercially available. The Crosfield Laser Mask system (available from the Crosfield Company of Glen Rock, N.J.), for example, utilizes a film support on which graphite particles in a binder are coated. The film support is exposed to a YAG laser. The heat generated by the absorption of the laser beam by the carbon particles causes the carbon to ablate from the film and transfer to a paper receiver. The image is built up, pixel by pixel, by removing carbon from low density areas of the image. The paper receiver constitutes a proof of the image, while the film from which the carbon was removed constitutes a negative transparency of the image. The transparency is utilized in the graphics art industry to expose or "burn" a lithographic plate.

While the system has met with some commercial success in the newspaper industry, the use of the YAG laser causes some difficulties. It is difficult, for example, to maintain and control the YAG laser, which requires substantial cooling and has a "noisy" beam in which the power varies erratically. The system also suffers from an inherent lack of resolution caused by the long wavelength of the YAG laser emission.

In order to overcome the difficulties experienced with the YAG laser, it has been suggested that a system be developed that utilizes a laser diode to expose the film support. U.S. Pat. No. 4,973,572, for example, discusses the use of a dye coating consisting of cyan, magenta and infra-red dyes in a cellulose nitrate binder which is exposed to a diode laser beam. An air stream was blown over the surface of the film support to remove sublimed dye. It has been found that the resulting dye removal gives a minimum optical density (Dmin) of 0.30. A Dmin value of 0.30, however, is too high to be generally useful in the graphic arts industry, as the piecing together of images with a Dmin of 0.30 with normal silver halide images having a Dmin of 0.04 and the exposing of a lithoplate with the composite, would result in the high Dmin image portions of the composite image formed therefrom being four times underexposed compared to the silver halide portions of the composite image. The result would be significant dot shrinkage in the underexposed portions of the image, with a corresponding change in printed density on a press. In fact, it is preferably that Dmin be limited to less than 0.11 to yield acceptable results.

The high Dmin portions of the image also suffer from visible raster lines, which have been found (as will be discussed in greater detail below) to be caused by the melting of the polyester substrate by the heating action of the diode laser beam. The melted raster lines may be viewed as a kind of non-uniformity in the image. Although the raster lines do not have an impact on contact image exposure, they do cause considerable flare in projection imaging systems like overhead projectors, and do constitute a noticeable cosmetic defect to customers accustomed to the uniform appearance of a silver halide negative.

In view of the above, it is an object of the invention to provide a method and apparatus for performing laser dye ablation printing utilizing a laser diode with improved contrast and uniformity, i.e., with Dmin reduced to preferably less than 0.11 and reductions in the appearance of raster lines.

SUMMARY OF THE INVENTION

The invention provides a method and apparatus for performing laser dye ablation printing utilizing a laser diode with improved contrast and uniformity. Film exposed in accordance with the invention has a Dmin of less than 0.11 and exhibits significant reductions in visible raster lines. Specifically, a laser printing apparatus is provided that includes a mechanism for retaining a film to be exposed, a laser diode source for generating a write beam, and a mechanism for scanning the write beam across the film to generate an image. The intensity of write beam generated by the laser diode source at the film is preferably at least 1.0 mW/square micron. During operation, a film to be exposed is placed in the retaining mechanism and the write beam is scanned across the film to generate an image.

BRIEF DESCRIPTION OF THE DRAWING

The invention will be described in greater detail with reference to FIG. 1, which illustrates a laser printing apparatus in accordance with the invention.

DETAILED DESCRIPTION OF PREFERRED EMBODIMENT

Figure 1:
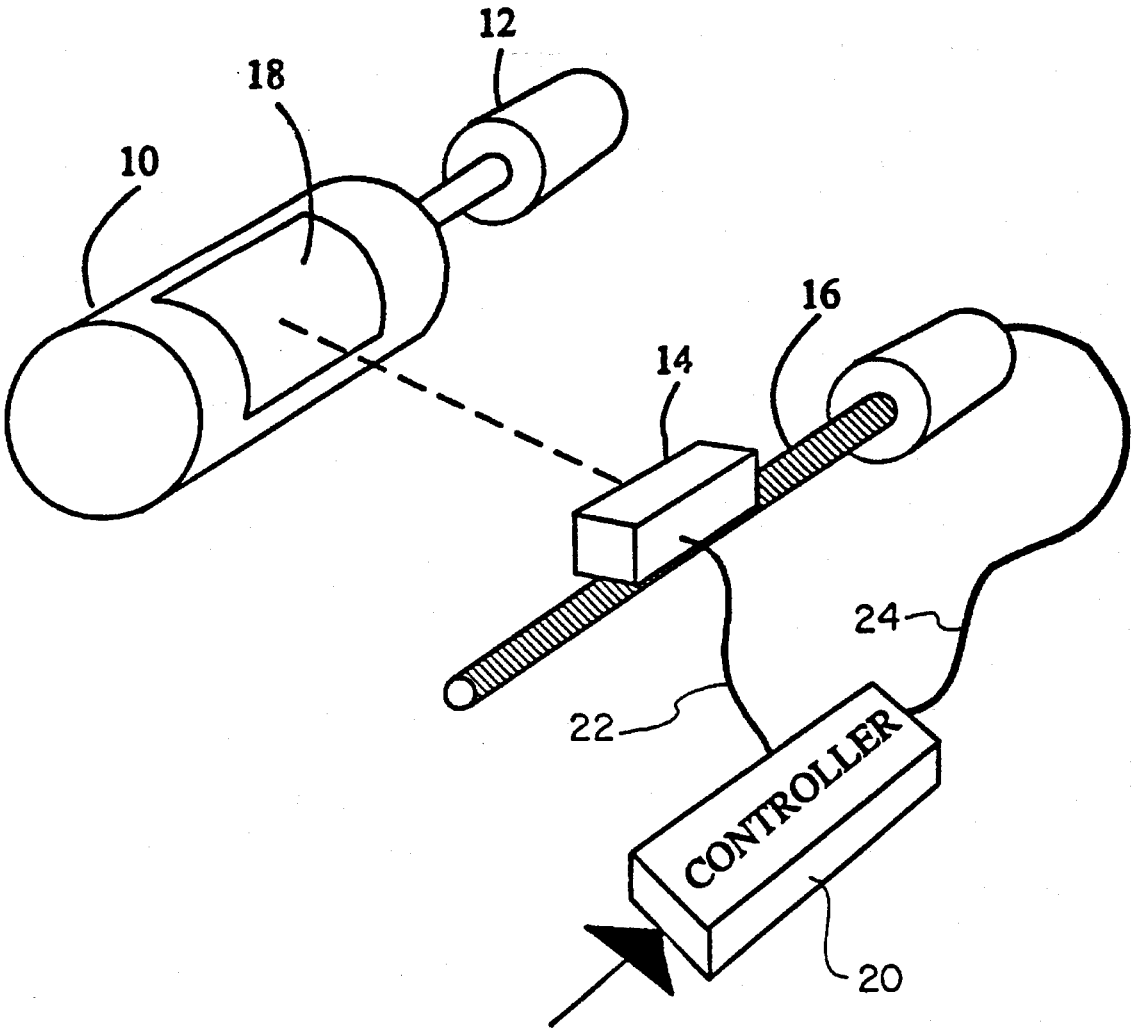

The invention is based, in part, on the discovery that the limit as to how low the Dmin value can go is a function of energy delivered to the film support. By utilizing a drum printer with a laser diode running at full power and varying the rotation speed of the drum, it has been observed that the Dmin value is high at fast rotations of the drum (low energy per unit area), the Dmin values improve as the drum is slowed (higher energy per unit area), but that the Dmin value begins to increase again as the drum is slowed further (highest energy per unit area). It is believed that at slow RPM's, the energy delivered to the film support is so high that the polyester base of the film begins to melt and discolor from the generated heat, thereby causing an increase in Dmin and the appearance of raster lines.

Another factor in determining the limit of the Dmin value of the film is the intensity of the laser spot. If a low power lens is used that writes a large area laser spot, the intensity of the laser beam will be low (for a given laser diode power). A high power lens that writes a small area spot will give a high intensity beam. A low intensity beam may not supply enough energy per unit area to raise the temperature of the dye layer high enough to remove all of the dye, which results in a high Dmin value. Thus, obtaining the best Dmin value is not just a factor of increasing the power of the laser source, but also is related to the intensity of the laser at the film surface.

In order to define the laser intensity needed for satisfactory image quality, an experiment was conducted using a laser printing apparatus of the type illustrated in FIG. 1. The apparatus includes an 70.446 cm circumference drum 10 driven by a motor 12 that is used to retain a film to be exposed, a printhead 14 incorporating a 500 milliwatt laser diode (power measured at drum surface) operating at 830 nm, and a motor driven leadscrew 16, operating at a 945 lines per centimeter pitch, which is used to linearly index the printhead 14. A controller 20 controls both the printhead 14 and the leadscrew 16 by way of electrical connections 22 and 24, respectively. The average spot size of the laser was 112 square microns, based on the 945 lines per centimeter pitch, and this value was used in calculations of the intensity of the laser beam (the measured gaussian beam of the laser at the $1/e^2$ point was 25×12 microns). A graphics film 18 was loaded onto the drum 10 and exposed to a series of power steps starting at 300 mW and decreasing by 6/255 of 300 for each step of the leadscrew 16.

The graphics film 18 was prepared using a 100 micron thick layer of polyethleneterphthalate coated with a mixture of the following dyes at a thickness of 24.2 cc/square meter:

100 parts cyan dye #1

100 parts cyan dye #2

175 parts yellow dye 175 parts infra-red dye 100 parts ultra-violet dye 350 parts nitrocellulose 11,900 parts solvent (metho iso-butyl ketone)

The compositions of the dyes are illustrated in Appendix A, attached hereto, which forms part of this specification. When dry, the film was overcoated with the following solution at 21.5 cc/square meter:

300 parts nitrocellulose 15 parts surfactant (Dow Corning silicon oil DC510)

24,000 parts solvent (butyl acetate)

The drum 10 was rotated at 100, 200, 300, 400 and 500 rpm, successively, and the graphics film 18 was exposed long enough to print several millimeters of an image at each of the specified drum speeds. After exposure, the Dmin densities were measured on an X-Rite 361T graphic arts densitometer (manufactured by X-Rite Company, of 4101 Roger B. Chaffee Drive, SE, Grand Rapids, Mich.) in the ultraviolet mode. The densitometer was zeroed on air. The results of the experiment are shown in Table 1 below:

TABLE 1

| MW/M² Laser Intensity | 100 rpm | 200 rpm | 300 rpm | 400 rpm | 500 rpm | MW Laser Power |
|---|---|---|---|---|---|---|
| 2.679 | 0.587 | 0.265 | 0.109 | 0.077 | 0.074 | 300.000 |
| 2.614 | 0.583 | 0.254 | 0.119 | 0.084 | 0.075 | 292.800 |
| 2.550 | 0.571 | 0.247 | 0.114 | 0.083 | 0.075 | 285.600 |
| 2.491 | 0.552 | 0.234 | 0.104 | 0.079 | 0.074 | 279.000 |
| 2.427 | 0.525 | 0.230 | 0.100 | 0.080 | 0.074 | 271.800 |
| 2.363 | 0.495 | 0.215 | 0.095 | 0.080 | 0.075 | 264.600 |
| 2.298 | 0.471 | 0.198 | 0.093 | 0.081 | 0.077 | 257.400 |
| 2.239 | 0.455 | 0.185 | 0.089 | 0.082 | 0.080 | 250.800 |
| 2.175 | 0.460 | 0.128 | 0.087 | 0.083 | 0.083 | 243.600 |
| 2.111 | 0.445 | 0.135 | 0.085 | 0.083 | 0.086 | 236.400 |
| 2.046 | 0.432 | 0.135 | 0.085 | 0.083 | 0.087 | 229.200 |
| 1.988 | 0.419 | 0.130 | 0.085 | 0.084 | 0.094 | 222.600 |
| 1.923 | 0.404 | 0.121 | 0.086 | 0.087 | 0.098 | 215.400 |
| 1.859 | 0.403 | 0.110 | 0.086 | 0.088 | 0.100 | 208.200 |
| 1.795 | 0.397 | 0.108 | 0.086 | 0.091 | 0.100 | 201.000 |
| 1.730 | 0.371 | 0.097 | 0.087 | 0.096 | 0.102 | 193.800 |
| 1.671 | 0.264 | 0.093 | 0.088 | 0.102 | 0.104 | 187.200 |
| 1.607 | 0.311 | 0.093 | 0.089 | 0.107 | 0.109 | 180.000 |
| 1.543 | 0.289 | 0.092 | 0.091 | 0.113 | 0.116 | 172.800 |
| 1.479 | 0.249 | 0.089 | 0.096 | 0.112 | 0.131 | 165.600 |
| 1.420 | 0.216 | 0.090 | 0.101 | 0.115 | 0.141 | 159.000 |
| 1.355 | 0.189 | 0.093 | 0.105 | 0.118 | 0.160 | 151.800 |
| 1.291 | 0.169 | 0.094 | 0.113 | 0.125 | 0.197 | 144.600 |
| 1.227 | 0.161 | 0.096 | 0.121 | 0.139 | 0.273 | 137.400 |

TABLE 1-continued

| MW/M² Laser Intensity | 100 rpm | 200 rpm | 300 rpm | 400 rpm | 500 rpm | MW Laser Power |
|---|---|---|---|---|---|---|
| 1.168 | 0.145 | 0.100 | 0.132 | 0.161 | 0.391 | 130.800 |
| 1.104 | 0.134 | 0.103 | 0.127 | 0.210 | 0.598 | 123.600 |
| 1.039 | 0.128 | 0.106 | 0.143 | 0.277 | 0.796 | 116.400 |
| 0.975 | 0.123 | 0.117 | 0.161 | 0.405 | 1.084 | 109.200 |
| 0.916 | 0.121 | 0.131 | 0.195 | 0.625 | 1.363 | 102.600 |
| 0.852 | 0.121 | 0.152 | 0.290 | 1.014 | 1.730 | 95.400 |
| 0.788 | 0.125 | 0.175 | 0.519 | 1.476 | 2.101 | 88.200 |
| 0.723 | 0.133 | 0.211 | 0.972 | 1.872 | 2.391 | 81.000 |
| 0.659 | 0.154 | 0.329 | 1.479 | 2.278 | 2.703 | 73.800 |
| 0.600 | 0.196 | 0.701 | 2.025 | 2.637 | 2.932 | 67.200 |
| 0.536 | 0.264 | 1.566 | 2.611 | 2.943 | 3.066 | 60.000 |
| 0.471 | 0.681 | 2.398 | 2.948 | 3.128 | 3.150 | 52.800 |
| 0.407 | 2.160 | 2.951 | 3.209 | 3.133 | 3.184 | 45.600 |
| 0.348 | 2.843 | 3.184 | 3.172 | 3.219 | 3.340 | 39.000 |
| 0.284 | 3.390 | 3.300 | 3.340 | 3.310 | 3.320 | 31.800 |

From Table 1, the threshold points where image quality is acceptable was extracted, i.e. the point at which Dmin becomes less than 0.11, and used to calculate the energy required for acceptable image quality. For example, Dmin was equal to 0.100 when the drum was running at 200 rpm and the average laser intensity (the power of the laser divided by the total area written) was 1.168, yielding a calculated exposure of 526 mJ/cm2 as shown by the calculation:

$$945/(200/60)(70.446)\times 130.8=526\ mJ/cm^2$$

The above calculation is based on one square centimeter being equal to 945 linearly written centimeters, the number of rotations per second multiplied by the drum circumference yielding the linear writing speed; dividing 945 by the linear writing speed to yield the square centimeter write time, and multiplying the square centimeter write time by the laser power to yield the exposure energy per square centimeter.

Table 2 illustrates exposure levels at additional points wherein Dmin is at about the same level. As shown by the data, higher laser intensities are more efficient and require less power to produce images of acceptable quality, while also permitting faster write times, i.e. higher drum speeds.

TABLE 2

| Average Intensity mWatts per square micron | Minimum Exposure (Dmin less than 0.11) mJoules per square centimeter |
|---|---|
| 1.168 | 516 |
| 1.42 | 426 |
| 1.671 | 377 |
| 1.859 | 335 |

As shown by the data illustrated in Table 1, Dmin increases for a given laser power level as the drum slows. For example, Dmin is 0.100 at 200 rpm when the average laser intensity is 1.168, but increases to 0.145 when the drum is slowed to 100 rpm. Similarly, for a drum speed of 200 rpm, an acceptable Dmin of less than 0.11 is achieved once the average laser intensity reaches about 1.0 mW/square micron (Dmin 0.106 for average intensity of 1.039 mW/square micron), but begins to climb out of the acceptable range when the average laser intensity increases (Dmin 1.110 for average laser intensity of 1.859 mW/square micron). It is believed that the increases in Dmin as the drum slows for a given intensity or as the intensity is increased for a given speed is due to the melting and/or discoloration of the film base as described above, which contributes to deformation and visibility of raster lines. Films having a Dmin of less than 0.11 were observed, however, to have significant reductions in visible raster lines. The amount of raster line thermal distortion of the film base was estimated by holding the film at arms length, observing a light source through the film, and noting the intensity of the rainbow of diffraction colors around the light source.

The invention has been described with reference to certain preferred embodiments thereof. It will be understood, however, that modifications and variations are possible within the scope of the appended claims. The invention, for example, is not limited to a rotating drum type printer in which a laser source is linearly indexed with respect to the rotating drum, but is also applicable to printers in which the film is scanned by rotating and indexing the laser source with respect to the film, or printers in which the film is exposed by scanning a laser beam from a fixed laser source. It will also be understood that the results obtained will vary, in some degree, with respect to the characteristics of the film, namely, the threshold intensity for obtaining an acceptable Dmin value for different certain films may require slightly higher or lower intensities than those illustrated in FIG. 1.

| Reference Numerals | |
|---|---|
| 10 | Drum |
| 12 | Motor |
| 14 | Printhead |
| 16 | Leadscrew |
| 18 | Film |

Appendix A

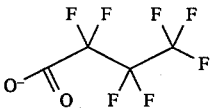

Infra-Red Dye

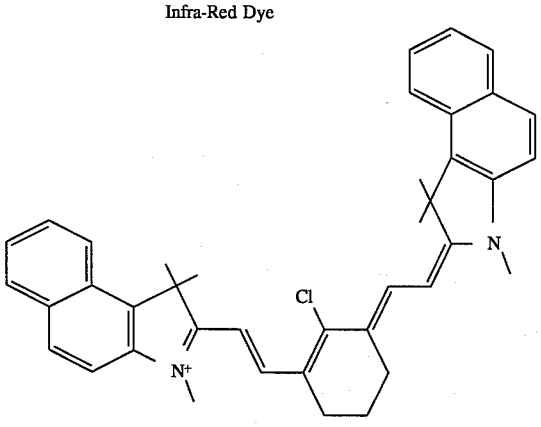

CYAN #1

-continued

Appendix A

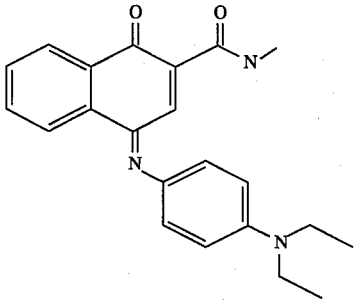

Yellow Dye

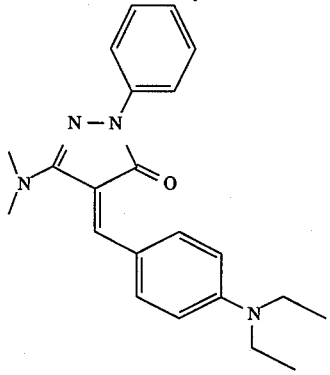

CYAN #2

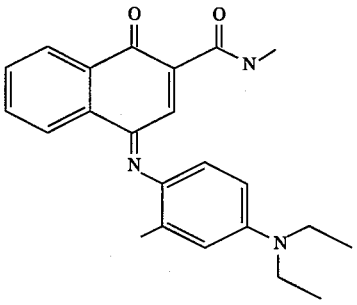

What is claimed is:

1. A laser printing apparatus comprising: means for retaining a film to be exposed, wherein the film includes a dye layer; a laser diode source for generating a write beam; means for scanning the write beam across the film to generate an image on the film having a minimum optical density (Dmin) of less than 0.11; and control means for controlling average intensity levels of said write beam generated by said laser diode;

wherein an average intensity of the write beam generated by the laser diode source at the film is at least 1.0 mW/square micron and wherein the image is generated on the film by the ablation of the dye layer by the write beam.

2. A laser printing apparatus as claimed in claim 1, wherein the average intensity of the write beam generated by the laser diode source at the film is at least 1.039 mW/square micron.

3. A laser printing apparatus as claimed in claim 1, wherein the average intensity of the write beam generated by the laser diode source at the film is at least 1.355 mW/square micron.

4. A laser printing apparatus as claimed in claim 1, wherein the average intensity of the write beam generated by the laser diode source at the film is at least 1.607 mW/square micron.

5. A laser printing apparatus as claimed in claim 1, wherein the average intensity of the write beam generated by the laser diode source at the film is in a range of 1.039 mW/square micron to 1.795 mW/square micron.

6. A laser printing apparatus as claimed in claim 1, wherein the an average intensity of the write beam generated by the laser diode source at the film is in a range of 1.355 mW/square micron to 2.491 mW/square micron.

7. A method of laser printing an image comprising the steps of:

retaining a film to be exposed with a film retainer, wherein the film includes a dye layer; generating a write beam with a laser diode source; scanning the write beam across the film to generate an image on the film having a minimum optical density (Dmin) of less than 0.11; and control means for controlling average intensity levels of said write beam generated by said laser diode;

wherein an average intensity of the write beam generated by the laser diode source at the film is at least 1.0 mW/square micron and wherein the image is generated on the film by the ablation of the dye layer by the write beam.

8. The method of laser printing an image as claimed in claim 7, wherein the average intensity of the write beam generated by the laser diode source at the film is at least 1.039 mW/square micron.

9. The method of laser printing an image as claimed in claim 7, wherein the average intensity of the write beam generated by the laser diode source at the film is at least 1.355 mW/square micron.

10. The method of laser printing an image as claimed in claim 7, wherein the average intensity of the write beam generated by the laser diode source at the film is at least 1.607 mW/square micron.

11. The method of laser printing an image as claimed in claim 7, wherein the average intensity of the write beam generated by the laser diode source at the film is in the range of 1.039 mW/square micron to 1.795 mW/square micron.

12. The method of laser printing an image as claimed in claim 7, wherein the average intensity of the write beam generated by the laser diode source at the film is in a range of 1.355 mW/square micron to 2.491 mW/square micron.

* * * * *